US006115839A

United States Patent [19]

Covington et al.

[11] Patent Number: 6,115,839

[45] Date of Patent: Sep. 12, 2000

[54] SURGICAL GOWN AND METHOD FOR MAKING THE SAME

[75] Inventors: David Loring Covington, Cumming, Ga.; Richard Howard Bell, Tucson, Ariz.

[73] Assignee: Kimberly-Clark Worldwide, Inc., Neenah, Wis.

[21] Appl. No.: 08/220,341

[22] Filed: Mar. 30, 1994

[51] Int. Cl.[7] ..... A41D 13/00

[52] U.S. Cl. ..... 2/69; 2/114; 2/51

[58] Field of Search ..... 2/69, 69.8, 46, 2/50, 51, 52, 69.5, 75, 104, 105, 106, 113, 114, 115

[56] References Cited

U.S. PATENT DOCUMENTS

| | | | |
|---|---|---|---|
| D. 236,293 | 8/1975 | Banks | D2/17 |
| D. 305,376 | 1/1990 | Russell | D2/29 |
| 2,528,340 | 10/1950 | Coven | 2/114 |
| 3,078,467 | 2/1963 | Artzt | 2/114 X |
| 3,353,189 | 11/1967 | Zimmon | 2/114 |
| 3,435,461 | 4/1969 | Artzt | 2/83 |
| 3,639,915 | 2/1972 | Hrubecky | 2/114 |
| 3,720,957 | 3/1973 | Patience | 2/114 |
| 3,921,221 | 11/1975 | Zoephel | 2/51 |
| 4,040,124 | 8/1977 | Zoephel | 2/51 |
| 4,041,203 | 8/1977 | Brock et al. | 428/157 |
| 4,587,671 | 5/1986 | Rodriguez, Jr. et al. | 2/69 |
| 4,608,719 | 9/1986 | Lunt | 2/114 |
| 4,631,756 | 12/1986 | Scrivens | 2/243 |
| 4,653,120 | 3/1987 | Leaf | 2/114 X |
| 4,686,714 | 8/1987 | Harley | 2/114 X |
| 4,819,275 | 4/1989 | Lunt | 2/114 |
| 4,829,602 | 5/1989 | Harreld et al. | 2/51 |
| 4,852,187 | 8/1989 | Johansson | 2/69 |
| 4,996,722 | 3/1991 | Jimenez et al. | 2/51 |
| 5,025,501 | 6/1991 | Dillon | 2/51 |
| 5,050,242 | 9/1991 | Udell | 2/114 |
| 5,062,160 | 11/1991 | Dillon, Jr. | 2/114 |

FOREIGN PATENT DOCUMENTS

| | | | |
|---|---|---|---|
| 0 460 907 | 12/1991 | European Pat. Off. | A41D 13/12 |
| 2 271 780 | 12/1975 | France | A41D 13/04 |

*Primary Examiner*—Jeanette Chapman
*Attorney, Agent, or Firm*—Hardaway Law Firm, P.A.; David J. Alexander

[57] ABSTRACT

Enhanced barrier protection for rear closure surgical gowns is provided by improved garment pattern design. The surgical gown of the present invention is formed from a garment blank having a first part, a center part and a second part wherein the first part and the second part are joined to the center part. The first part includes a pair of side edges spaced apart by a bottom edge. The second part includes a pair of side edges spaced apart by an upper edge. The upper edge of the second part is of greater length than the bottom edge of the first part. Portions of the center part define a neck opening. The side edges of the second part extend inwardly from the upper edge towards the center part. A slit, defined by edges in the second part, extends from the upper edge to the neck opining. In this way, when joining the side edges of the first and second parts to from the surgical gown, portions of the second part near the edges defining the slit overlap.

1 Claim, 4 Drawing Sheets

SURGICAL GOWN AND METHOD FOR MAKING THE SAME

FIELD OF THE INVENTION

This invention relates to gowns and other garments and particularly to surgical gowns and methods for making the same. More particularly, this invention relates to improved gown assembly techniques, the use thereof providing improved barrier protection and material utilization.

BACKGROUND OF THE INVENTION

As is generally known, sterile surgical gowns are designed to greatly reduce, if not prevent, the transmission through the gown of liquids and biological contaminats which may become entrained therein. In surgical procedure environments, such liquid sources include the gown wearer's perspiration, patient liquids, such as blood and life support liquids such as plasma and saline.

Many of these surgical gowns were originally made of cotton or linen and were sterilized prior to the use in the operating room. These gowns, however, permitted transmission or "strike-through" of various liquids encountered in surgical procedures. In these instances, a path was established for transmission of bacteria and other contaminats to and from the wearer of the gown. Furthermore, these gowns were costly, and of course laundering and sterilization procedures were required before reuse.

Disposable surgical gowns have largely replaced linen surgical gowns. Because many surgical procedures require total liquid repellency to prevent strike-through, disposable gowns for use under these conditions are made entirely from liquid repellent or impervious fabrics. However, there are many surgical procedures which may permit the use of surgical gowns which are not totally liquid impervious. In these instances, disposable gowns which are not totally liquid impervious are made with such liquid repellent or impervious fabrics selectively positioned so as to provide the wearer with strike-through protection in the areas of the gown most likely to contact or be contacted by liquids. Such partial liquid impervious gowns provide greater breathability and wearer comfort.

Whether the surgical procedure dictates the use of a surgical gown which is totally liquid impervious or a surgical gown which is not totally liquid impervious, it is generally preferred that gown closure about the wearer's body occur at the wearer's back and not the wearer's front. In this way, the portion of the gown which overlies the wearer's chest and abdomen may be formed from an uninterrupted sheet of materials, albeit that such sheet may be formed from a plurality of pieces of material which are stitched or seamed together.

While a continuous gown front provides improved barrier protection in the areas of the gown most likely to contact or be contacted by liquids as compared to gown fronts which are gaped or interrupted by a closure means, the barrier protection provided by the back of the gown is also a concern of health care providers, gown manufactures and patients alike. This is so because traditional closure means used in disposable surgical gowns, which for example include, buttons, hooks, tape, and ties, may create gaps in the back of the gown. In some instances these gaps occur around the union of or adjacent to the back panels. The presence of such gaps around the union of the back panels of back closure gowns provides direct and/or unrestricted avenues of passage to and from the wearer for contaminats, such as those described above.

Therefore, whether the surgical gown is disposable or reusable or liquid impervious or partially liquid impervious, there exist a need for back closure gowns, and methods of making the same, which provide improved barrier protection and particularly improved barrier protection for the back of the wearer's body overlaid by the gown.

SUMMARY OF THE INVENTION

In response to the above problems encountered by those skilled in the art, the present invention provides a surgical gown having an area of overlap which provides improved barrier protection for the wearer's body. More particularly, the present invention provides a surgical gown having a neck opening and opposed panels having non-parallel side edges which define a slit. The slit extends from the opening to a bottom edge of the gown. When the gown is in use, portions of the opposed panels overlap along substantially the entire length of the slit.

The present invention further provides a back closure surgical gown having a front section and a pair of back panels which close about the wearers back. The back panels are formed such that portions thereof overlap creating an area of overlap. The area of overlap generally extends the length of the surgical gown and increases from the opening to the bottom edge. In one embodiment, the shape of the overlap may resemble the shape of an inverted "V".

The present invention further provides a garment blank for use in forming the surgical gown of the present invention. The garment blank includes a center part, a first part and a second part both joined to the center part. The first part has a pair of side edges spaced apart by a bottom edge. The second part has a pair of side edges spaced apart by an upper edge of greater length than the bottom edge. A portion of the center part defines a neck opening. One of the side edges of the second part extends inwardly from the upper edge towards the center part. The garment blank may be formed from a single sheet of material. The garment blank may also be formed from a plurality of pieces of material joined together to achieve substantially the same shape as that of the garment blank formed from the single sheet of material.

DETAILED DESCRIPTION OF THE INVENTION

Several terms may be used herein to refer to various parts of the gown as the gown is worn. Thus, "front" refers to that part of the gown which overlays the chest or anterior plane of the wearer; "back" refers to that part of the gown which overlays the back or posterior plane of the wearer, "side" or "sides" refer to that part of the gown which overlays the side or lateral portion(s) of the wearer and which may extend to and overlap the back or front portions of the wearer and are generally located between the front and the back. The term "outer" or "outside" describes that surface of the gown which faces away from the wearer when the gown is being worn; "inner" or "inside" refers to the surface of the gown, or part thereof which faces either the clothes or body of the wearer, while "left" and "right" respectively refer to portions of the gown corresponding to the left and right hand sides of the gown, respectively, as the gown is being worn. The term "continuous sheet" or "continuous sheet of material" describes a sheet or a sheet of material which is formed from a single piece of material and not formed by affixing, such as by sewing or gluing so as to form a seam, two or more pieces of material.

Additionally, several terms may be used herein to refer to affixing one part of the gown to another part. These terms include "join", "secure", "attach" and derivatives and synonyms thereof. The affixing of these pieces of gown parts to one another may be accomplished by any of several conventional methods. By way of example and not limitation, these methods include stitching, gluing, heat sealing, zipping, snapping, sonic or thermal bonding or using a hook and loop fastening system and other methods familiar to those skilled in the art.

Figure 1:
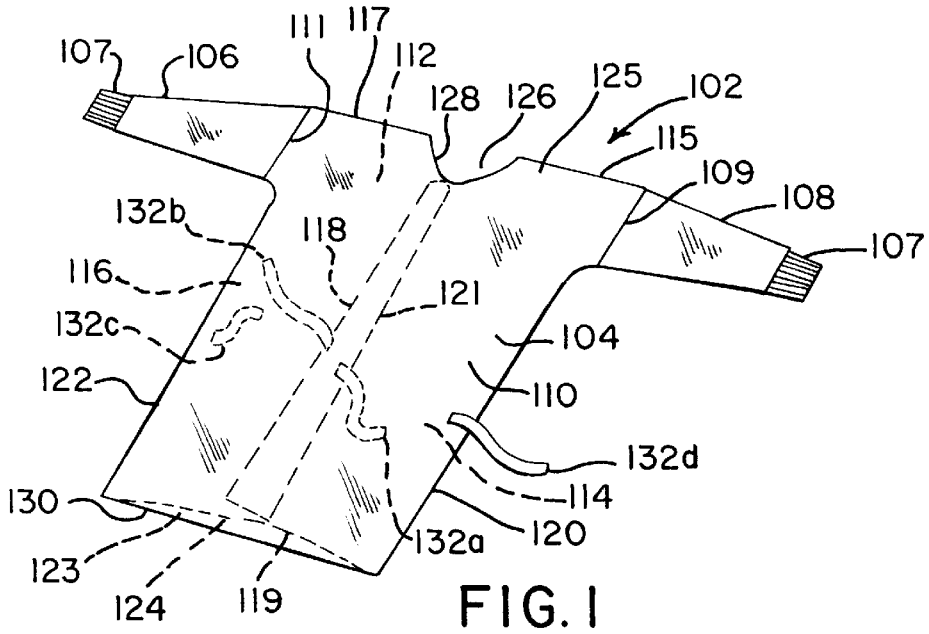
FIG. 1 is a front isometric view of a surgical gown of the present invention.

Turning now to the drawings and referring first to FIG. 1, the gown 102 may be formed from a sheet of material and more particularly a continuous sheet of material. The gown 102 includes a body 104 and right and left sleeves 106 and 108, respectively. Both the right and left sleeves, 106 and 108, respectively, are provided with form fitting cuff sections 107. The right sleeve 106 is secured to the body 104 at a right edge 111 and the left sleeve 108 is secured to the body 104 at a left edge 109.

The body 104 has a closed front section 110 and an open back section 112. The back section 112 is provided with a pair of opposed panels, i.e., a left back panel 114 and a right back panel 116 which open and close about the wearers body. It will be understood that while the sections 110 and 112 are describe above as front and back sections, respectively, the gown of the present invention may be worn such that the opposed panels, 114 and 116, of the section 112 open and close about the wear's chest and the closed section 110 is located about the wear's back.

The left back panel 114 is generally defined by a left upper edge 115, a left back panel edge 118, a bottom edge 119 and a left side edge 120. The right back panel 116 is generally defined by a right upper edge 117, a right back panel edge 121, a right side edge 122 and a bottom edge 123. When the surgical gown 102 is in use, the left back panel edge 118 and the right pack panel edge 121 are non-parallel. A portion of the right back panel 116 around the right back panel edge 121 and a portion of the left back panel 114 around the left back panel edge 118 overlie when the gown is in use and forms an area of overlap 124. As will be discussed in greater detail below, a slit 127, defined by edges 118 and 121, generally extends the length of the back section 112.

The front section 110 is defined by the upper edges 115 and 117, a bottom edge 130, the right side edge 122 and the left side edge 120. A neck opening 126, defined by a neck edge 128, is formed generally between the left upper edge 115 and the right upper edge 117.

Figure 2:
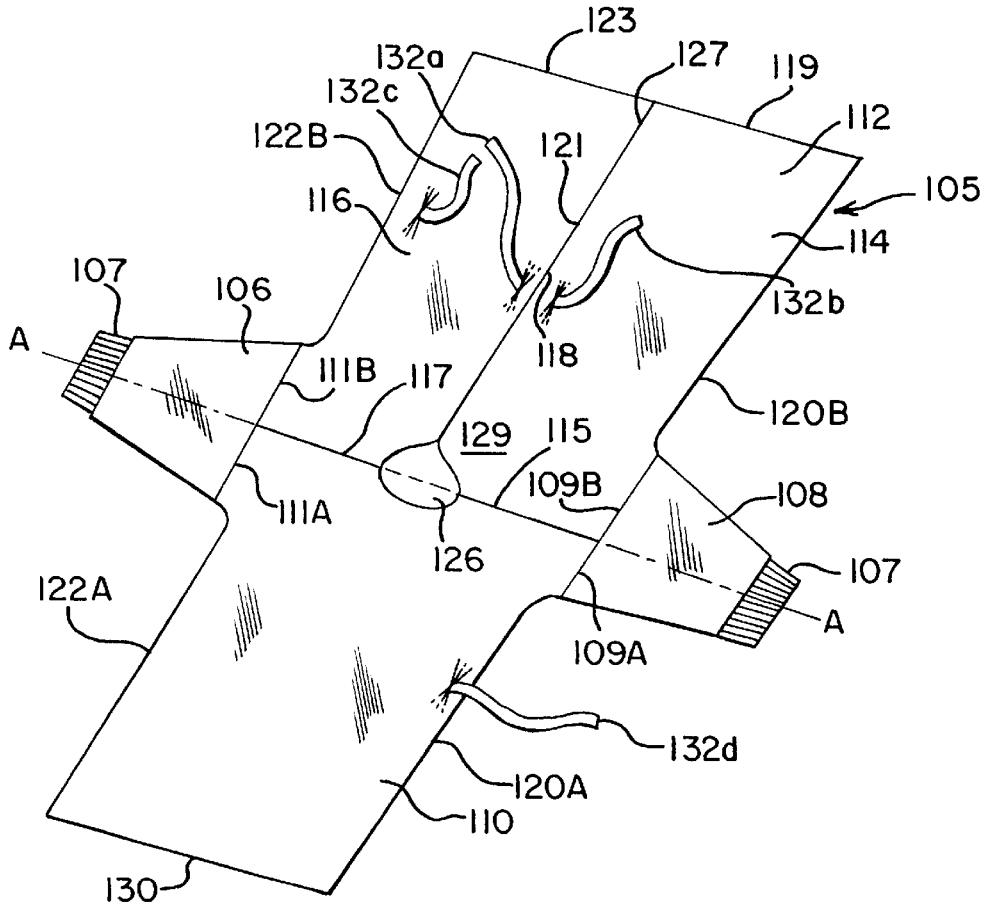
FIG. 2 is a front isometric view of the surgical gown of FIG. 1 unfolded about line A—A.

The slit 127 extends from the neck opening 126 to the bottom edges 119 and 123 of the back panels 114 and 116 (FIG. 2). The area of overlap 124, which may be generally shaped in an inverted V configuration, may extend from the neck opening 126 to the bottom edges 119 and 123 of the back panels 114 and 116, respectively. The amount of overlap between the right and left back panels, 116 and 118, respectively, generally increase from the neck opening 126 to the bottom edges 119 and 123.

As will be discussed in greater detail below, the right back panel 116 is secured to the front section 110 along the right side edge 122. The left back panel 118 is secured to the front section 110 along the left side edge 120. The right side edge 122 extends from the bottom edge 130 and terminates around the base of the right edge 111. The left side edge 120 extends from the bottom edge 130 and terminates around the base of the left edge 109.

The gown 102 further includes a plurality of ties 132 *a–d*. The ties 132 *a–d* are for the purpose of conformally securing the gown 102 about the body of the wearer.

Referring now to FIG. 2, the gown 102 has been unfolded about line A—A, so as to form a garment blank 105. It will be appreciated that in this unfolded configuration about line A—A, the upper edges 115 and 117 are overlaid by portions of line A—A.

The garment blank 105 may be formed from a sheet of material and particularly a continuous sheet of material. The garment blank 105 may also be formed from a plurality of pieces of material which may be joined together to achieve substantially the same shape as that of the garment blank formed from a single or continuous sheet of material.

With continued reference to FIG. 2, for convenience of description, the bottom edges 123 and 119 of the gown 102 may be referred to as upper ends 123 and 119 of the garment blank 105 while the bottom edge 130 of the gown 102 is also referred to as the bottom edge 130 of the garment blank 105. It will be further noted in both FIGS. 2, 3 and 5, that the right back panel edge 121 and the left back panel edge 118 are abutting and as such, the area of overlap 124 illustrated in FIG. 1 is not illustrated in FIGS. 2, 3 and 5. It will be further noted that the tie 132*a* is secured near the right back panel edge 121 and the tie 132*b* is secured near the left back panel edge 118. The tie 132*c* is secured to a portion of the right back panel 116 near the right side edge 122B. The tie 132*d* is secured to the front section 112 near the left side edge 120A.

With continued reference to FIG. 2, a first part 110 of the garment blank 105 (generally the front section 110 of the gown 102) is generally defined by the bottom edge 130, a right side edge 122A and a left side edge 120A. As is more clearly illustrated in FIG. 3, the right side edge 122A and the left side edge 120A of the garment blank 105 are generally parallel.

Figure 3:
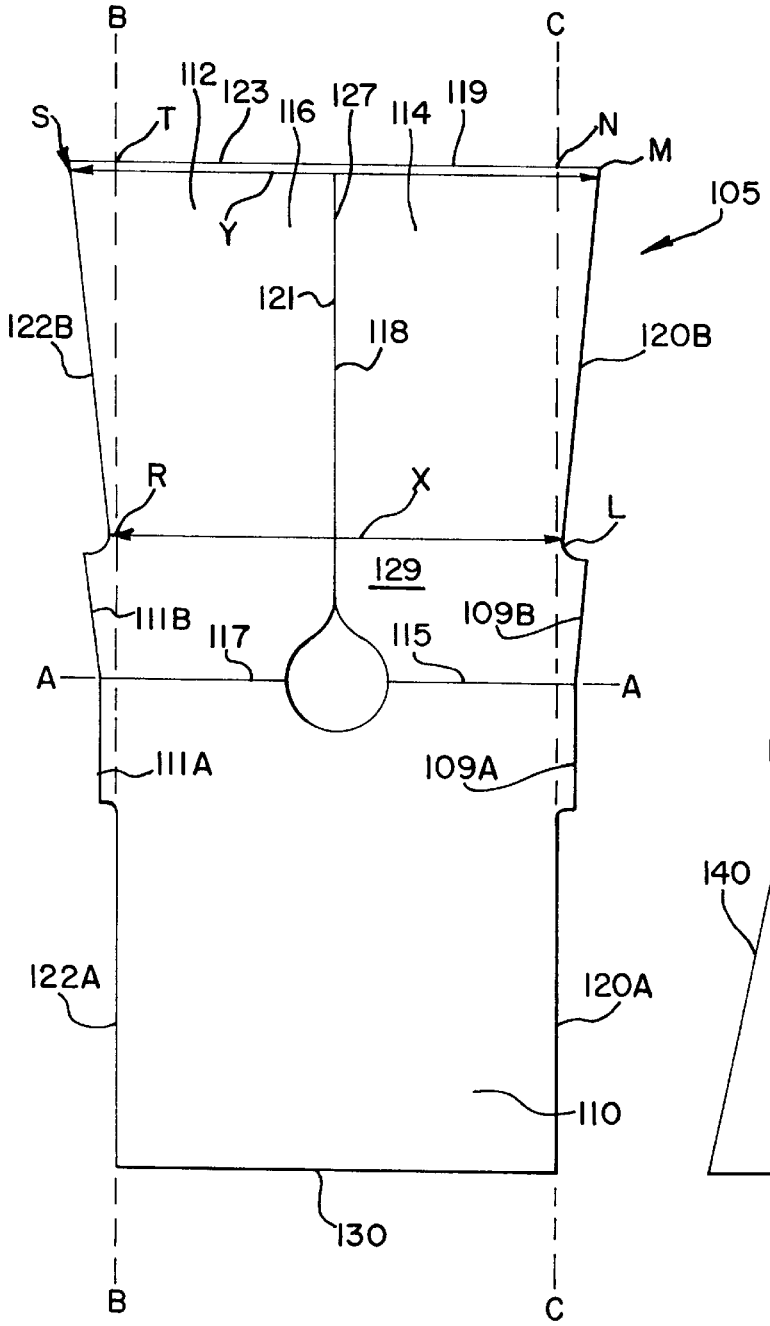
FIG. 3 is a front plan view of a garment blank.

In the unfolded configuration illustrated in FIGS. 2 and 3, the front section 110 is also more clearly defined by the bottom edge 130, the left side edge 120A, the right side edge 122A, a left edge 109A, a right edge 111A and the upper edges 115 and 117.

A second part 112 of the garment blank (the back section 112 of the gown 102 which includes the right and left back panels, 116 and 114, respectively) is generally defined by the upper edges 119 and 123, a right side edge 122B and a left side edge 120B. The right side edge 122B and the left side edge 120B are non-parallel. Additionally, the upper edges 123 and 119 are parallel to the bottom edge 130 of the garment blank 105.

As is more clearly illustrated in FIGS. 2 and 3, the left back panel 114 is defined by the edge 119, a left side edge 120B, the left back panel edge 118, a left edge 109B, the upper edge 115 and the neck opening 126. The right back panel 116 is more clearly defined by the edge 123, the right side edge 122B, the right back panel edge 121, a right edge 111B, the upper edge 117 and the neck opening 126.

As previously mentioned, the slit 127 is defined by the right and left back panel edges, 121 and 118, respectively. The slit 127 is generally parallel to the left and right side edges, 120A and 122A, respectively. The slit 127 extends generally the length of the second part 112 from the neck opening 126 to the upper edges 123 and 119. Additionally, the slit 127 is spaced an equal distance from the sides edges 120B and 122B.

A center part 129 of the garment blank is generally defined by the portion of the garment blank between the right edges 111A and B and the left edges 109A and B. Portions of the center part 129 define the neck opening 126.

As is more clearly illustrated in FIG. 3, the right side edge 122B and the left side edge 120B of the garment blank 105 are non-parallel. More particularly, the distance "X" between the portion of the right side edge 122B at point R and the portion of the left side edge 120B at point L is less than the distance between "Y" the portion of the right side edge 122B at point S and the portion of the left side edge 120B at point M. In this way, the right side edge 122B and the left side edge 120B converge, or extend inwardly, from the intersection at their respective upper edges, 123 and 119, to the center part 129. The convergence of the right side edge 122B and the left side edge 120B is further illustrated by the parallel dashed lines B—B and C—C.

The distance between the dashed lines B—B and C—C is generally equal to the length of the bottom edge 130. The dashed line B—B overlies the right side edge 122A and extends from the bottom edge 130 of the first part 110 to a point T in the upper edge 123 of the second part 112. The dashed line C—C overlies the left side edge 120A and extends from the bottom edge 130 of the first part 110 to a point N in the upper edge 119 of the second part 112.

As is further illustrated by the dashed lines B—B and C—C, the combined length of the upper edges 119 and 123, illustrated by line S–M is greater than the length of the bottom edge 130, illustrated by line T–N. As such, the two triangular portions of the second part 112, the first triangular portion being defined by the lines, R–S, S–T and T–R and the second triangular portion being defined by the lines L–M, M–N and N–L, extend outboard of the side edges 120A and 122A of the first part 110.

Figure 4:
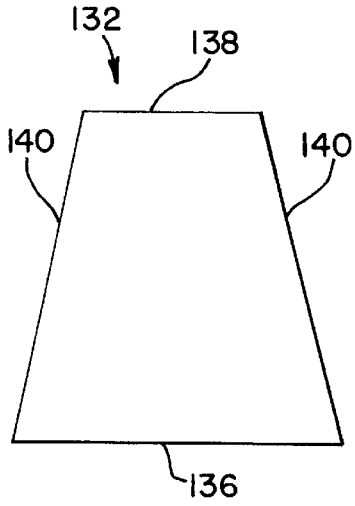
FIG. 4 is a front plan view of a surgical gown sleeve.

Referring now to FIG. 4, a sleeve section 132 is illustrated. It will be appreciated that the sleeve section 134 may be used for forming either the right sleeve 106 or the left sleeve 108. The sleeve section 134 is generally trapezoid-shaped having a wide edge 136, a narrow edge 138 and non-parallel edges 140. The wide edge 136 of one of the sleeve sections 134 is attached to the right edge 111 of the garment blank 105. Another sleeve section is attached to the left edge 109 of the garment blank 105 in a similar manner (FIG. 2).

Referring now to FIGS. 1–4, the gown 102 may be assembled by securing the ties 132 to the back panels 114 and 116 as described above. The garment blank 105 may then be folded about line A—A to form the body 104. Upon folding about line A—A, the front section 110 overlies the back section 112. The right side of the gown 102 is formed by aligning, then joining, the right side edges 122A and 122B. Alignment of the right side edges 122A and 122B forms the right side edge 122 (FIG. 1) and results in a portion of the right back panel 116 along the right back panel edge 121 overlapping the left back panel 114. The portion of the right back panel 116 overlapping the left back panel 114 is generally similar in size and shape to the triangle RST (FIG. 3). Alignment of the right side edges 122A and 122B also aligns the right edges 111A and 111B.

The left side of the gown 102 is formed by aligning and then joining the left side edges 120A and 120B. Alignment of the left side edges 120A and 120B forms the left side edge 120 (FIG. 1) and results in a portion of the left back panel 114 along the left back panel edge 118 being urged towards the right side edge 120. The portion of the left back panel 114 so urged is generally similar in size and shape to the triangular portion of the left back panel 114 defined by the triangle LMN (FIG. 3). Alignment of the left side edges 120A and 120B also aligns the left edges 109A and 109B forming the left edge 109 (FIG. 1).

As a result of the formation of the left and right sides edges, 120 and 122, respectively, portions of the right back panel 116 around the right back panel edge 121 overlie portions left back panel 114 around the left back panel edge 118 thus forming the area of overlap 124 (FIG. 1).

The sleeve sections 132 are then joined to the body 104 as described above. Once joined to the body 104, the edges 140 of each sleeve section may be joined and the form fitting cuff sections 107 may be joined to edges 138.

Figure 5:
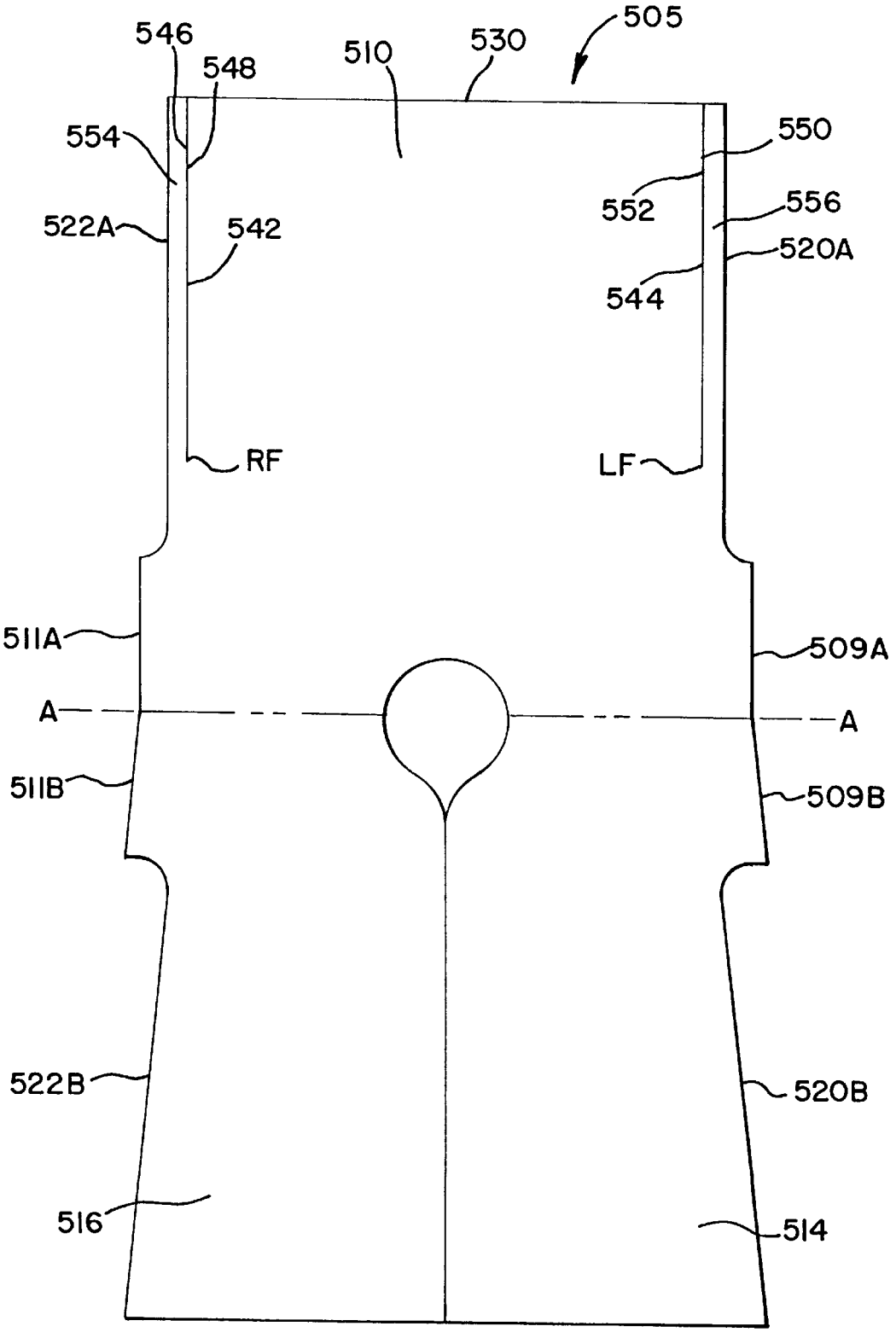
FIG. 5 is a front plan view of a alternative embodiment of the garment blank illustrated in FIG. 3.

Turning now to FIG. 5 a garment blank 505 is similar to the garment blank 105 with the exception that the front section 510 of the garment blank 505 is provided with a pair of slits 542 and 544, each near the side edges 522A and 520A, respectively. The slit 542 is defined by edges 546 and 548. The slit edge 542 is defined by edges 550 and 552.

The slit 542 begins at the bottom edge 530 and extends generally parallel to the right side edge 522A terminating at a point RF in the front section 510. In this way, a right side tie 554, defined generally by edges 522A, 546 and a portion of the bottom edge 530 between the edges 522A and 546 is formed in the front section 510.

The formation of a left side tie 556 in the front section 510 is similar to the formation of the right side tie 554. The slit 554 begins at the bottom edge 530 and extends generally parallel to the left side edge 520A terminating at a point LF. The left side tie 556 is defined generally by edges 520A, 550 and a portion of the bottom edge 530 between edges 520A and 550.

Figure 6:
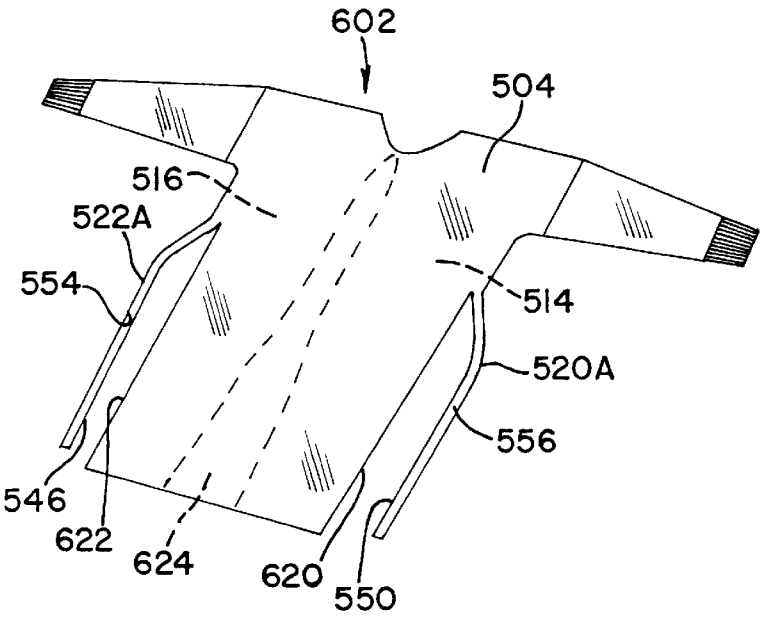
FIG. 6 is a front isometric view of a surgical gown formed from the garment blank illustrated in FIG. 5.

The gown 602, illustrated in FIG. 6, is formed from the garment blank 505, and is assembled in a similar manner as the gown 102 illustrated in FIGS. 1 and 2, with the exception of the absence of the ties secured to the left and right back panels, 514 and 516, respectively, (which are optional for the embodiment illustrated in FIG. 6) and the formation of left and right side edges, 620 and 622, respectively, of the gown 602.

The right side edge 622 of the gown 602 is formed by joining a portion of the right side edge 522A between point RF and right edge 511A (FIG. 5) to a corresponding portion of the right side edge 522B. The remaining length of the right edge 522B is joined to the edge 548.

The left side edge 620 of the gown 602 is formed by joining a portion of the left side edge 520A between point LF and the left edge 509A (FIG. 5) to a corresponding portion of the left side edge 520B. The remaining length of the left edge 520B is joined to the edge 552. In this way, the tie 554 is free for engagement with tie 556. In addition, an area of overlap 624 is formed by the back panels 514 and 516 in a similar manner as the area of overlap 124 (FIG. 1) is formed by back panels 114 and 116.

Figure 7:
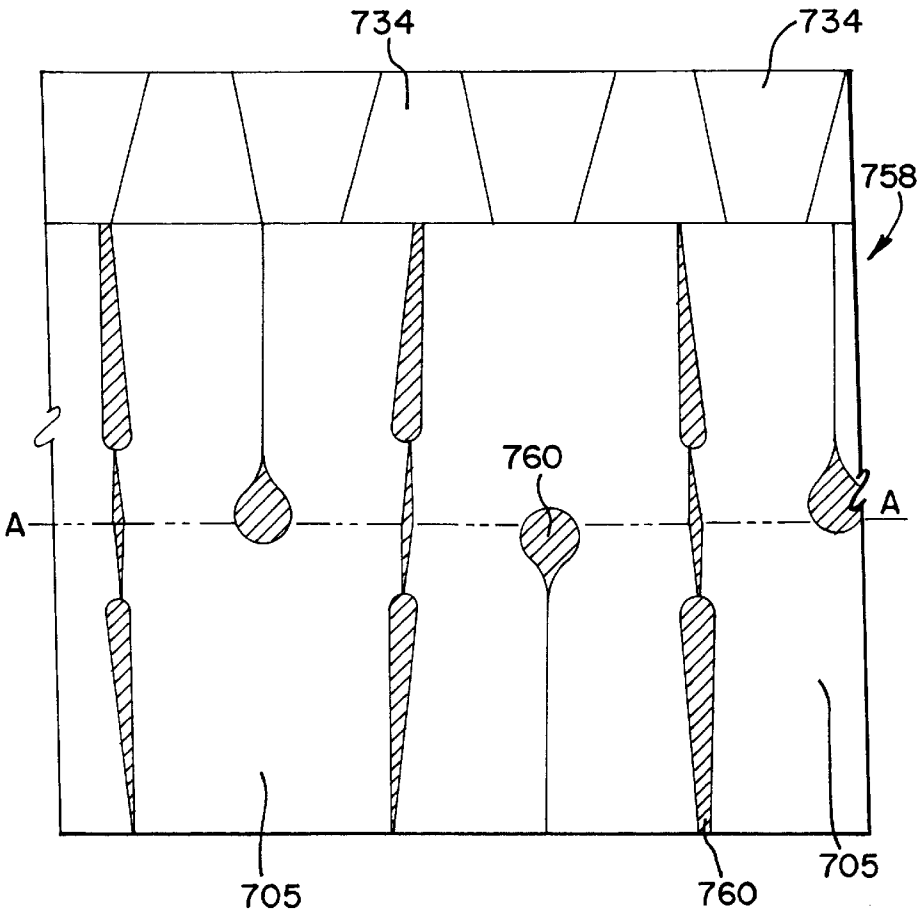
FIG. 7 is a plan view of a continuous sheet of material illustrating a plurality of garment blank cut-out patterns and surgical gown sleeve cut-out patterns.

Referring now to FIG. 7, a plurality of garment blank patterns 705 are illustrated in an alternating up-down sequence on a single sheet or web of material 758. On the same wed of material 758, a plurality of sleeve section patterns 734 in a alternating up-down sequence are illustrated. The shaded areas 760 illustrate the slight amount of web material which is not included in the garment patterns 705.

It is noted that the present invention may be made from a multitude of materials including nonwoven materials suitable for disposable uses. For examples the gown may be made of stretchable nonwoven material so that the gown is less likely to tear during the donning or wearing of the gown. A material well-suited for use with the present invention is a three-layer nonwoven polypropylene material known as SMS. SMS is an acronym for Spunbond, Meltblown, Spunbond, the process by which the three layers are constructed and then laminated together. See for examples U.S. Pat. No. 4,041,203 to Brock et al. One particular advantage is that the SMS material exhibits enhanced fluid barrier characteristics. It should be noted, however, that other nonwovens as well as other materials including wovens, films, foam/film laminates and combinations thereof may be used to construct the gown of the present invention. It is also contemplated that the gown may be coated with a liquid impervious coating to prevent fluid absorption into the gown material.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

What is claimed is:

1. A garment blank comprising:

a center part;

a first part having a pair of side edges spaced apart by a bottom edge;

a second part having a pair of side edges spaced apart by an upper edge wherein portions of the second part define a slit, and wherein the second part is adapted to overly the back of the wearer;

wherein the first and second parts are joined to the center part and wherein the length of the upper edge of the second part is greater than the length of the bottom edge of the first part and wherein portions of the first part near each of the side edges thereof define a slit extending from the bottom edge of the first part and terminating in the center part.

* * * * *